US005769728A

United States Patent [19]

Kasino

[11] Patent Number: 5,769,728

[45] Date of Patent: Jun. 23, 1998

[54] BALL TRACKER TRICK SHOTS ON A POOLTABLE OR HOME FLOOR OR TABLE

[76] Inventor: Pete Kasino, Alcott Post Office 3700, Tennyson, Denver, Colo. 80212

[21] Appl. No.: 621,217

[22] Filed: Mar. 25, 1996

[51] Int. Cl.[6] ..... A63B 37/00

[52] U.S. Cl. ..... 473/2

[58] Field of Search ..... 473/2, 3; 238/10 E

[56] References Cited

U.S. PATENT DOCUMENTS

| | | | |
|---|---|---|---|
| 366,318 | 7/1887 | Hughes | 273/115 |
| 1,482,633 | 2/1924 | Fergusson | 238/10 E |
| 1,813,116 | 7/1931 | Clausen | 473/3 |
| 1,931,606 | 10/1933 | Ewen | 238/10 E |
| 2,081,682 | 5/1937 | Smith | 238/10 E |
| 2,231,089 | 2/1941 | Rorer | 273/108 |
| 2,670,206 | 2/1954 | Brewster | 273/120 |
| 2,862,333 | 12/1958 | Gardiol | 238/10 E |
| 2,866,645 | 12/1958 | Cayot | 473/278 |
| 3,013,726 | 12/1961 | Orel | 238/10 E |
| 3,220,122 | 11/1965 | Miller | 473/2 |
| 3,587,190 | 6/1971 | Ashton | 238/10 E |
| 5,275,398 | 1/1994 | Compton | 473/2 |
| 5,370,308 | 12/1994 | Black | 238/10 E |
| 5,401,215 | 3/1995 | Pfost | 473/2 |
| 5,431,398 | 7/1995 | Simpkins | 473/2 |

*Primary Examiner*—Theatrice Brown

[57] ABSTRACT

The ball tracker is designed to do trick shots on a pool table or a flat surface such as a table or floor, with a ball catcher that takes the place of a pool table pocket. The invention has different length tracks for the balls to roll on the directions you want it to go. It has directional guides for left and right turns, 45°, 90°, 120° or other means for turns. It also has a ball jumper so the cue ball can jump over another ball.

When the tracks are attached to the directional turns you can make the ball go to any direction you want it to. This invention allows non-skilled pool shooters to make fantastic trick shots. It is a whole new concept of pool.

13 Claims, 4 Drawing Sheets

BALL TRACKER TRICK SHOTS ON A POOLTABLE OR HOME FLOOR OR TABLE

TECHNICAL FIELD

This invention relates to aiming and tracking the pool balls to go exactly where you want them to go. The method is very simple, nearly everybody can do it. It is fun and it gives the player a good feeling of confidence. They can even make up their own shots.

BACKGROUND

I did a patent search at the Central Denver Public Library in Denver, Col. with over fifty different pool related patents and none were like this invention. One was a ball game device U.S. Pat. Office No. 5,431,398 Simpkins has a round upright cylinder when a ball was dropped into the cylinder it would project the ball across a horizontal surface. The principle objective of this invention are to provide a tubular passage way for accelerating a cue ball across a playing surface and determine the level condition of the playing surface of a pool table, U.S. Pat. No. 5,25,398 apparatus for pool and billiards games. Compton the apparatus includes a stick assembly and an arrays of light reflectors attached to the tables. The stick assemble includes a stick and a laser unit connected to the stick. The stick has a spring loaded ram. When the trigger is pulled the stick shoots the ball controlled by an aimed light beam, and U.S. Pat. No. 5,401,215 billiard ball aiming system, Pfost. This aiming system is entirely different than this invention. These patents indicate that there is a need for the ball tracker to make the pool balls go exactly where you want them to go.

SUMMARY OF THE INVENTION

The present invention which consists of some different size tracks and directional turn guides and a directional ball jumper guide and a directionally ball guide and a start and finish track ramp and a ball catcher which can take the place of a pool table pocket when these useful parts are put together to make a continuous track, then the difficult trick shots become easy to make. You can make any shot you want to, you can even shoot one ball into another ball and make the other ball do the trick shot. It is truly a novelty accomplishment.

This invention was designed to use ball tracks and directional guides. Once the tracks are attached to the directional guides and placed in the direction you want it to go, then you put the cue ball in front of the upper ball ramp which is attached to the ball track. When the cue ball is hit with a cue stick, the ball goes up a short ramp into the ball track and goes wherever the track lead it to. It will continue to go in the same direction every time; you can shoot the same shot every timer and not miss. You can shoot the cue ball into any pocket or ball catcher anytime you want to and as many times as you want to and never miss. You can use any standard size cue stick, cue, ball, pool table, and means with this invention to make the shots. At the end of the shot the lower ball ramp which is attached to the end of the ball track, lets the ball down gently to the flat surface of the table completing the shot.

All directional guides have cloth or some soft means attached to the bottom of directional guides to protect the cloth on the pool table.

DISCLOSURE OF THE INVENTION

Figure 1:
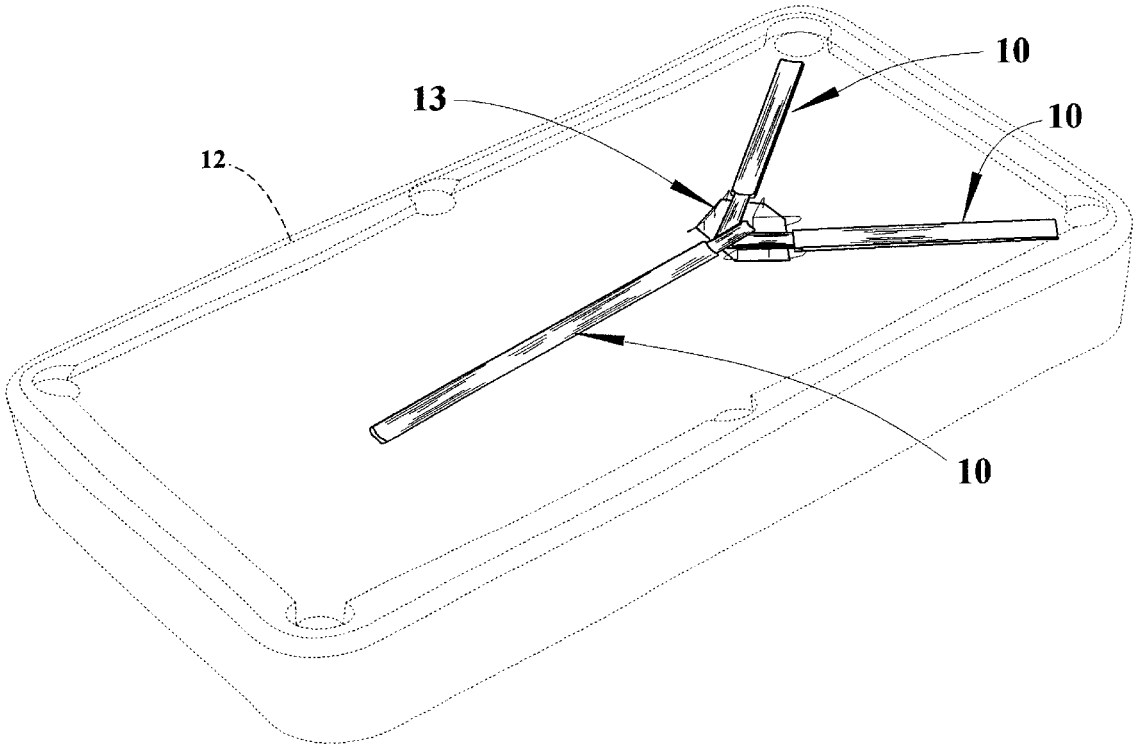
FIG. 1 is a drawing of a pool table with the Y directional ball guide that shows hot it is placed on the table to make two balls to go into two different directions into two different pool table pockets.

FIG. 1 shows a Y 13 is a directional guide placed on a pool table 2 it has a ball track 10 attached to the upper part of the Y where the cue ball is shot and enters the center of the Y where two balls will be placed in the center of the Y, side by side, touching each other when the cue ball comes in contact with both balls at the same time. One ball goes left on the back track 10 and into the left pocket of the pool table, the other ball goes right on the ball track 10 and rolls into the right pocket of the pool table.

Figure 2:
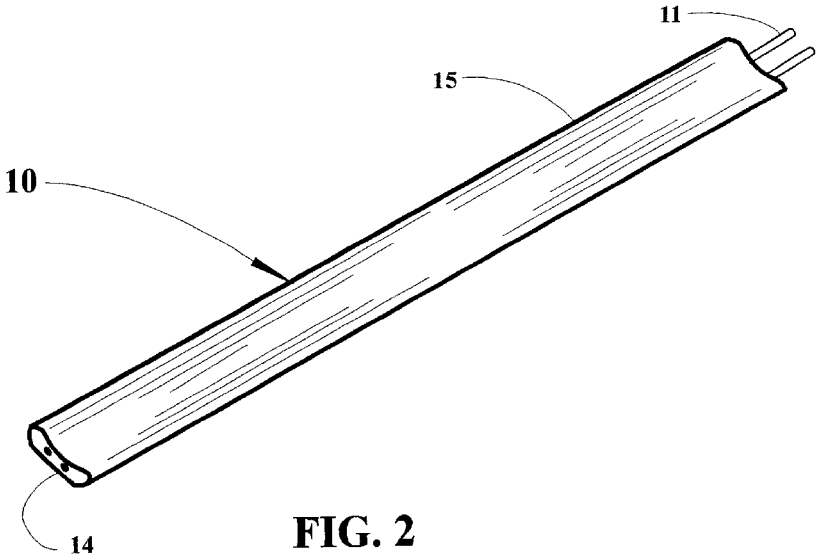
FIG. 2 is a drawing of a pool ball track which a pool ball rolls on to reach its destination.

FIG. 2 shows the ball track 10 that was used in FIG. 1 to guide the balls into the pockets of the pool table 12 of FIG. 1 No. 15 of FIG. 2 is the top of 10 which is the ball track 10 and has about one fourth of an inch groove down the center of the track which keeps the ball from rolling off the track 11 of FIG. 2 are wire pins which connects to another track or directional guides with holes like in the connections can be made of clamps, hooks, and other means. The track in FIG. 2 is approximately one and one half inches wide and is made of plastic metal and other means.

Figure 3:
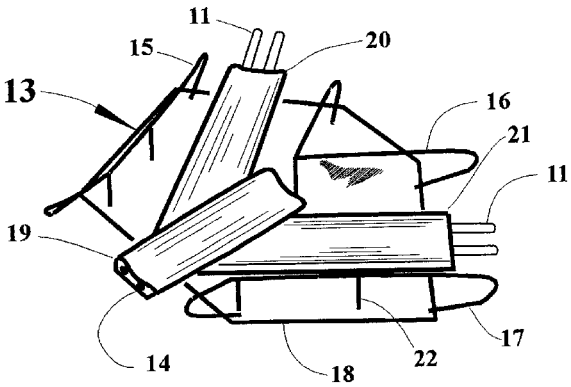
FIG. 3 is a close up drawing of FIG. 1.

FIG. 3 is a close-up of FIG. 1 the Y directional guide 20 of FIG. 3 is a smaller track. It is about one inch wide with about one eight inch groove down the center of the track No.

21 is the same track as No. 20 in FIG. 3. No. 19 is the track that the ball enters into the Y. It is the same size as 20 and 21. It enters into the Y and strokes two balls that travel on 20 and 21 track. No. 11 and 14 are the connections for the tracks No. 13, 15, 16, 17 are the ball guides to keep the ball in control to make the turns while they are in the directional guides. No. 22 are ball guide supports. In FIG. 3, 18 is the base for FIG. 3 the Y directional guide.

Figure 4:
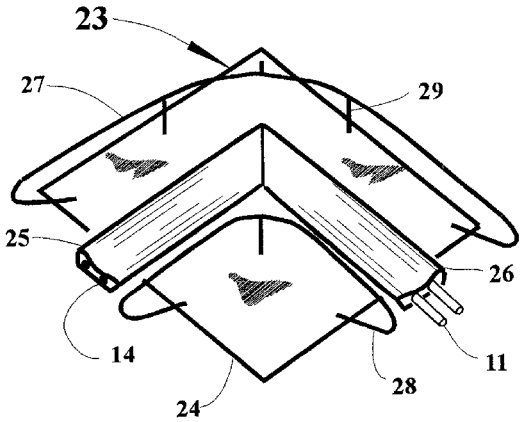
FIG. 4 is a drawing of a directional ball guide which allows a pool ball to travel at a 90° degree angle to make a left turn if it enters the right side and a right if it enters the left side. All ball guides have about 2½" wide rails.

FIG. 4 is a right and left directional 90° degree turn guides. 11 and 14 are track connectors, 23 and 24 are the base for the 90° directional guide. 25 and 26 are the small ball tracks. FIG. 2 is the wider large track. 27 and 28 are ball guides and 29 is the supports for the ball guides.

Figure 5:
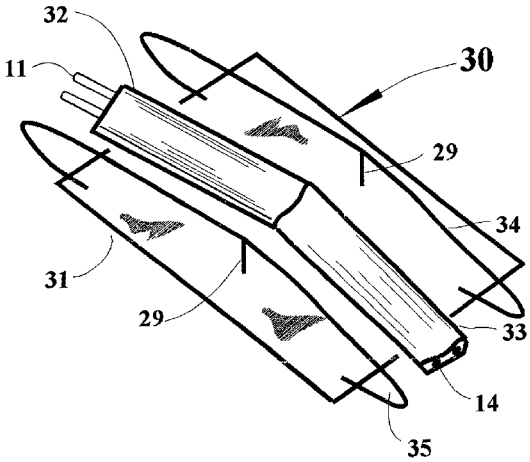
FIG. 5 is a drawing of a 45° degree directional turn guide which also makes a 45° degree right turn if it is entered from the right side and a 45° degree right turn if it is entered from the left side.

FIG. 5 is a 45° directional guide for left and right turns. 11 and 14 are track connectors. 34 and 35 are ball guides, 29 are ball guide supports. 30 and 31 is the base for the 45° directional guide. 32 and 33 are small tracks for directional turns.

Figure 6:
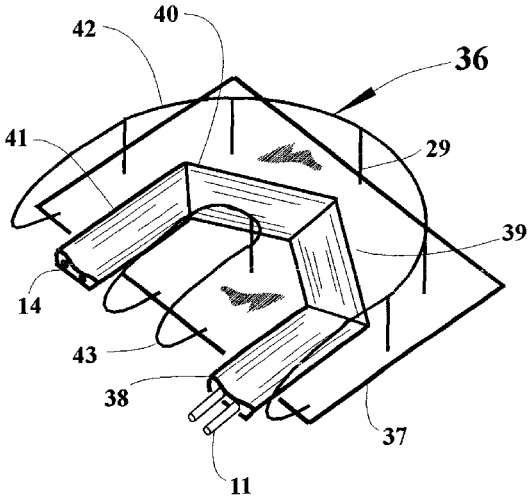
FIG. 6 is a 180° degree directional guide which also makes a 180° degree right turn if entered from the left side and a 180° degree left turn if it is entered from the right side.

FIG. 6 is a 120° degree directional guide. 11 and 14 are track connectors; 29 is supports for ball guides; 38, 39, 40, 41 are small tracks for turn guides. 36, 42, 43 are ball guides in FIG. 6.

Figure 7:
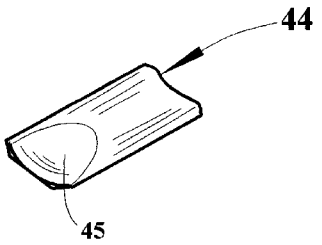
FIG. 7 is a drawing of a lowering ball ramp which is attached to the end of the track to lower the ball gently to the table.

FIG. 7 is the end of the track lower ramp to ease the ball off the track onto the table. 45 of FIG. 7 is the lower ramp that is cut at about 45° degree slant for the ball to fall down smoothly to the table. 44 is the lower ramp track. It is made from the same material as the track and has the same connectors.

Figure 8:
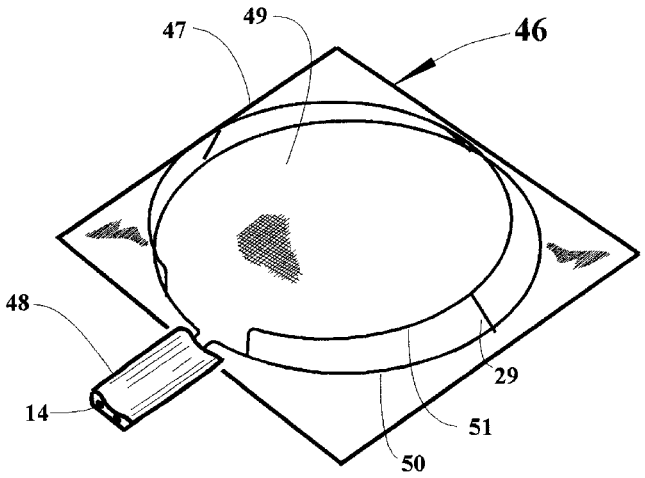
FIG. 8 is a drawing of a ball catcher which can take the place of a pool table when using it at home on a table or floor.

FIG. 8 is the ball catcher when a ball does a trick shot it rolls into the ball catcher instead of a pool table pocket. 14 track connector 48 small ball track 46, 47, 49. The base of the ball catcher 29 is supports for ball guides. 50 and 41 are ball guides.

Figure 9:
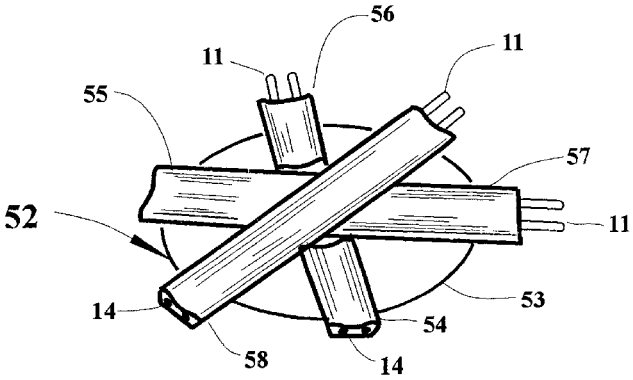
FIG. 9 is a drawing of a six way directional ball guide track. The ball can travel left to right and right to left on all three of these crossings which makes it a six way directional track.

FIG. 9 is a six way ball tracks crossings 11 and 14 are track connectors. 52 and 53 and 53 is the base for the six way ball track crossings 54, 55, 56, 57, 58 are all small tracks with track connectors.

Figure 10:
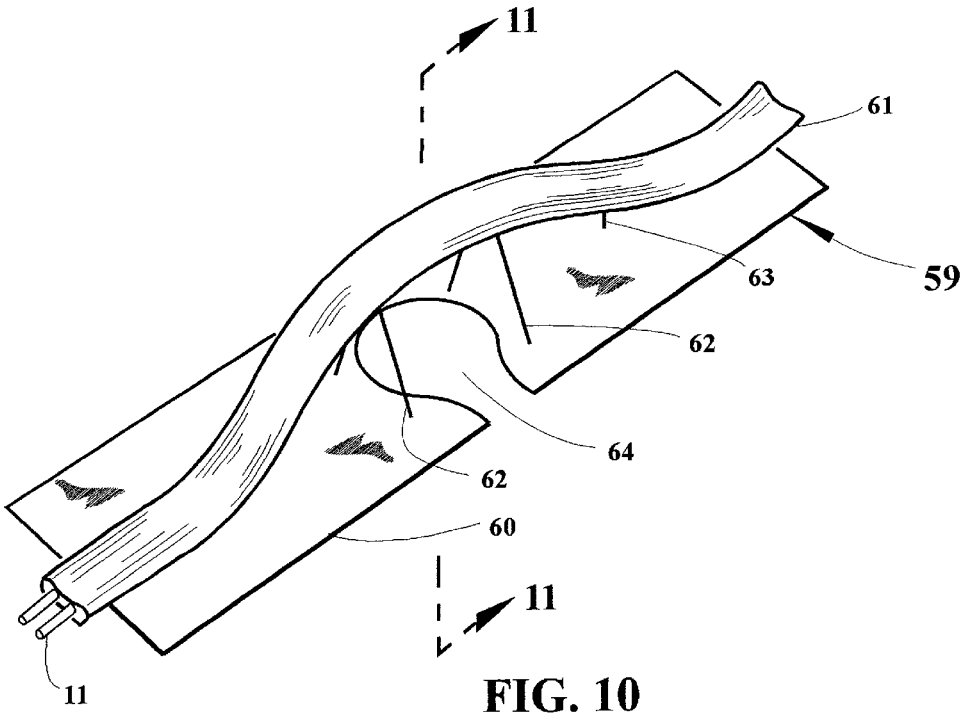
FIG. 10 is a drawing of a ball jumper directional ball guide. It has an opening at the center of the base of it, that is about 2½" in diameter. It can be placed straight down over a ball or if a ball is nearby on a jumper rail, and you can't put the ball jumper straight down over it, slide the ball jumper under and around the bottom of the ball without moving or touching it, when the tracks are attached to each side of the ball jumper, the ball can roll on the track and right over the ball underneath.

FIG. 10 is the ball jumper, directional guide 11 is the track connectors. 61 is the curved track, the shapes of the ball tracks that can be used for the ball tracker invention is straight, long, short, wide, narrow, curved, round and means 62 and 63.

FIG. 10 are supports for the ball jumper tracks. 64 is an opening for a ball to fit into when the ball jumper is placed over a ball, 59 and 60 is the base of the ball jumper. The bases for all FIGS. 1 through 12 for this invention are made of plastic, metal, wood and means. 64 is the opening which is about 2½" in diameter.

Figure 11:
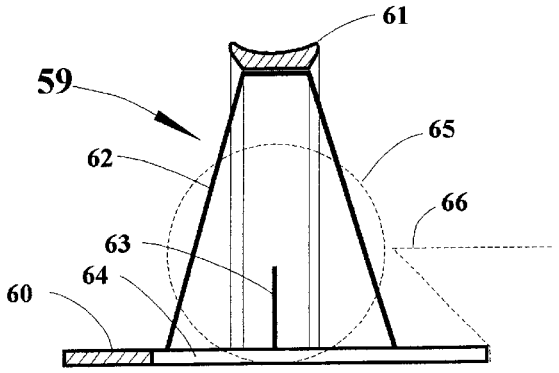
FIG. 11 is a drawing of a front view of the ball jumper placed over a ball which is against a pool table rail.

FIG. 11. 59 is the front view of the ball jumper placed over a ball near a pool table rail. 66, 62 and 63 are supports for the jumper track. 65 is the ball; 61 is the ball track.

Figure 12:
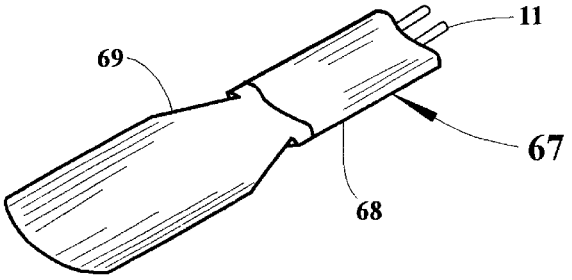
FIG. 12 is a drawing of a starter ramp. Place the ball in front of the ramp, stroke it with a cue stick and the ball will go up the ramp onto the track to travel to its destination.

FIG. 12. 67 is the upper ramp for getting the ball on the ball track by stroking it with a cue stick. 11 is the track connector; 68 is the wide track; 69 is the tapered part of the ramp that touches the surface of the table that makes it easy to put the ball upon the track.

I claim:

1. A track system in combination with a pool table having a surface, the system for guiding a ball over the surface of the pool table, the system comprising:

a pool table having a flat playing surface and at least two sections of track adapted for accepting a ball, the sections of track including:

at least one flat section of track for accepting a ball, said flat section of said track having connection means for attaching said section of track to another section of track, at least one raised section of track for allowing a ball on the track to roll over another ball, the raised section of track having:

a base, said base having an opening for accepting a ball, the raised section of track extending over the opening at a distance that allows placement of a ball in said opening; means on said section of track engaging said connection means so that said flat section of track is attached to said raised section of track such that a ball propelled to roll along said flat section of track will roll over a ball placed within the opening in said base of said raised section of track.

2. A track system according to claim 1, further comprising: at least one flat section of track having a generally Y-shape for controlling the direction of motion of a ball moving thereon; and connection means for attaching said Y-shaped section of track to said another section of track, so that a ball rolling on a section of track will roll onto said Y-shaped section of track.

3. A track system according to claim 2, further comprising at least one 90 degree flat section for controlling the direction of motion of a ball moving thereon; and connection means for attaching said 90 degree flat section of track to said another section of track.

4. A track system according to claim 3, further comprising: at least one 45 degree flat section of track for controlling the direction of motion of a ball moving thereon; and connection means for attaching said 45 degree flat section of track to said another section of track.

5. A track system according to claim 1, further comprising: a ball catcher for receiving balls rolling off of said flat section of track.

6. A method for producing trick shots on a pool table, the method comprising:

providing a track system for guiding a ball over the pool table, the system comprising:

at least one section of track for accepting a ball, the section of track defining:

means for controlling the direction of motion of a ball moving thereon, and connection means for attaching said section of track to another section of track;

providing at least one flat section of track having a generally Y-shape and defining means for controlling the direction of motion of a ball moving thereon, said Y-shaped section of track comprising a central section of track having sides, and a section of track extending diagonally from each side of the central section, said Y-shaped section of track having connection means attaching said Y-shaped section to said another section of track, and attaching the Y-shaped section said another section of track;

placing a pool ball on the track system; and propelling the pool ball on one of the sections, so that the ball will roll from one section of track to said another section of track.

7. A method according to claim 6, and further comprising: providing at least one 90 degree flat section of track for controlling the direction of motion of a ball moving thereon; connection means attaching said 90 degree flat section of track to said another section of track, and attaching the 90 degree flat section of track said another section of track so that a ball rolling on said section of track will roll on to said 90 degree flat section of track.

8. A method according to claim 7, further comprising: providing at least one 45 degree flat section of track for controlling the direction of motion of a ball moving thereon; connection means for attaching said 45 degree flat section of track to another section of track, and attaching the 45 degree flat section of track to said another section of track so that a ball rolling on said another section of track will roll on to said 45 degree flat section of track.

9. A method according to claim 6, further comprising: the steps of providing a ball catcher for receiving balls rolling off of said flat section of track, and attaching the ball catcher to said another section of track so that a ball rolling on said another section of track will roll into said ball catcher.

10. A track system in combination with a pool table; comprising:

a pool table having a flat playing surface; at least two sections of track adapted for accepting a ball, the sections of track including:

at least one section of track defining direction guide means for controlling the direction of motion of a ball moving thereon, and connection means for attaching said section of track to another section of track;

at least one flat section of track having a generally Y-shape, said Y-shaped section of track comprising a central section having sides and a section of track extending diagonally from each side of the central section of track, said Y-shaped section of track having connection means for attaching said Y-shaped section of track to said at least one section and said another section of track, so that a ball rolling on said at least one section and said another section of track may roll onto said Y-shaped section of track; and at least one raised section of track adapted for allowing a ball on the track to roll over another ball beneath the track, the raised section of track having a base; said base having a substantially flat section and an opening for accepting a ball, the raised section of track extending over the opening; means on said raised section attaching said raised section of track to said at least one and said another section of track, so that a ball propelled to roll along said section of track will roll from one section of track and onto another section of track.

11. A track system according to claim 10, further comprising: at least one 90 degree flat section of track for controlling the direction of motion of a ball moving thereon; and connection means for attaching said 90 degree flat section of track to said another section of track.

12. A track system according to claim 11, further comprising: at least one 45 degree flat section of track for controlling the direction of motion of a ball moving thereon; and connection means for attaching said 45 degree flat section of track to said another section of track.

13. A track system according to claim 12, further comprising: a ball catcher for receiving balls rolling off of said flat section of track.

* * * * *